US006547925B1

(12) United States Patent
Drew et al.

(10) Patent No.: US 6,547,925 B1
(45) Date of Patent: Apr. 15, 2003

(54) METHOD OF APPLYING CHEMICAL SOFTENING AGENTS FOR MAKING SOFT TISSUE

(75) Inventors: Sherri Lynn Drew, Sherwood, WI (US); Peter John Allen, Neenah, WI (US); Stephen John McCullough, Fond du Lac, WI (US)

(73) Assignee: Kimberly-Clark Worldwide, Inc., Neenah, WI (US)

( * ) Notice: Subject to any disclaimer, the term of this patent is extended or adjusted under 35 U.S.C. 154(b) by 0 days.

(21) Appl. No.: 08/897,337

(22) Filed: Jul. 21, 1997

(51) Int. Cl.[7] ..... B31F 1/12

(52) U.S. Cl. ..... 162/111; 162/179; 162/164.1; 162/158; 264/283

(58) Field of Search ..... 162/109, 111, 162/112, 113, 158, 164.1, 179, 135; 264/282, 283; 156/183

(56) References Cited

U.S. PATENT DOCUMENTS

| | | | | | |
|---|---|---|---|---|---|
| 2,996,424 | A | * | 8/1961 | Voigtman et al. | 162/112 |
| 3,014,832 | A | * | 12/1961 | Donnelly | 162/111 |
| 4,406,737 | A | | 9/1983 | Latimer et al. | 162/111 |
| 4,448,638 | A | | 5/1984 | Klowak | 162/112 |
| 4,684,439 | A | * | 8/1987 | Soerens | 162/111 |
| 4,720,383 | A | | 1/1988 | Drach et al. | 424/70 |
| 5,094,717 | A | | 3/1992 | Manning et al. | 162/111 |
| 5,217,576 | A | | 6/1993 | Van Phan | 162/158 |
| 5,225,047 | A | | 7/1993 | Graef et al. | 162/9 |
| 5,234,547 | A | | 8/1993 | Knight et al. | 162/111 |
| 5,382,323 | A | * | 1/1995 | Furman, Jr. et al. | 162/111 |
| 5,399,241 | A | | 3/1995 | Oriaran et al. | 162/112 |
| 5,520,781 | A | | 5/1996 | Curham et al. | 162/199 |
| 5,695,607 | A | * | 12/1997 | Oriaran et al. | 162/112 |

FOREIGN PATENT DOCUMENTS

| | | |
|---|---|---|
| AU | 13167/92 | * 10/1992 |

* cited by examiner

*Primary Examiner*—Jose A. Fortuna
(74) *Attorney, Agent, or Firm*—Gregory E. Croft

(57) ABSTRACT

An especially soft creped tissue can be produced by the indirect addition of chemical softening agents to the tissue web by applying the chemical softening agents to the surface of the Yankee dryer, such as by spraying. More specifically, the softening agents can be included as part of the creping adhesive formulation, which is sprayed onto the surface of the Yankee dryer between the creping blade and the pressure roll. The softening agents are subsequently transferred to the tissue sheet surface as the sheet is pressed against the Yankee dryer.

7 Claims, 1 Drawing Sheet

METHOD OF APPLYING CHEMICAL SOFTENING AGENTS FOR MAKING SOFT TISSUE

BACKGROUND OF THE INVENTION

The use of softening agents in the manufacture of tissues, such as facial and bath tissue, is common practice in the industry. These tissues typically contain a blend of relatively long fibers, which are usually softwood fibers, and relatively short fibers, which are usually hardwood fibers. Commonly, the softening agent is added to the short fibers prior to forming the web since the short fibers primarily contribute to tissue softness. The long fibers are separately treated with strengthening agents (wet and dry) and refining. Both refining and strengthening agents are often used because excessive use of either treatment may have an adverse effect on the tissue making process and/or the resulting tissue product.

However, the conventional method of adding softening agents to the fiber furnish can have some disadvantages. In one case, softening agents added to a furnish prior to forming cause internal debonding which results in loss of tensile strength and increased dust when the sheet contacts the creping doctor blade. The loss in tensile strength may require excessive refining or strength additive which can have a detrimental effect on tissue softness. Excessive dust may increase the frequency of sheet breaks at the reel, provide a less than desirable environment for machine operators and is detrimental to the consumer perception of the tissue.

Therefore there is a need for a more efficient method of utilizing softening agents in the manufacture of tissues.

SUMMARY OF THE INVENTION

It has now been discovered that an especially soft creped tissue can be produced by the indirect addition of chemical softening agents to the tissue web by applying the chemical softening agents to the surface of the Yankee dryer, such as by spraying. More specifically, the softening agents can be included as part of the creping adhesive formulation, which is sprayed onto the surface of the Yankee dryer between the creping blade and the pressure roll. The softening agents are subsequently transferred to the tissue sheet surface as the sheet is pressed against the Yankee dryer.

The softening agent remains predominantly on the surface of the sheet where it is most beneficial, thereby resulting in a slicker, more lotiony surface feel desired by consumers. Some of the softening agent passes through the sheet while in the pressure roll nip and is recirculated back to the wet end of the tissue machine with the white water. As such, additional amounts becomes incorporated into the tissue sheet at that point of the process, but these amounts are more evenly distributed throughout the sheet. The net result is a tissue sheet having a greater concentration of softening agent on the surface of the sheet, thereby improving the surface softness of the sheet relative to sheets made in a conventional manner.

Hence in one aspect the invention resides in a method for making creped tissue comprising: (a) forming a wet tissue web by depositing an aqueous papermaking furnish onto a forming fabric; (b) partially dewatering the tissue web; (c) applying a creping adhesive and one or more softening agents to the surface of a Yankee dryer; (d) adhering the tissue web to the surface of the Yankee dryer such that the softening agent is transferred to the tissue web; and (e) creping the web.

In another aspect, the invention resides in a tissue product made by the abovementioned method.

Suitable softening agents used as part of the adhesive formulation include a range of chemistries that contribute a soft, silky, smooth, velvety, fluffy, lotiony, cushiony, quilted, delicate, satiny, and soothing feel to the tissue. These agents include, but are not limited to: imidazoline quaternaries; ester quaternaries; phospholipids; silicone phospholipids; silicone quaternaries; quaternized lanolin derivatives; hydrolyzed wheat protein/polydimethyl siloxane; hydrolyzed wheat protein/dimethicone phosphocopolyol copolymer; organoreactive polysiloxanes; nonionic surfactants, such as alkylphenol ethoxylates, aliphatic alcohol ethoxylates, fatty acid alkoxylates, fatty alcohol alkoxylates, and block copolymers of ethylene oxide and propylene oxide; condensation products of ethylene oxide with the product resulting from the reaction of propylene oxide and ethylenediamine; condensation products of propylene oxide with the product of the reaction of ethylene oxide and ethylenediamine; semipolar nonionic surfactants, such as water soluble amine oxides; alkylpolysaccharides, such as alkylpolyglycosides; fatty acid amide surfactants; polyhydroxy compounds, including glycerol, polyethylene glycols, and polypropylene glycols having a weight average molecular weight from 200 to 4000; quatemized protein compounds; silicone emulsions and silicone glycols.

The amount of softening agent added to the Yankee dryer can be any amount that is effective in increasing the softness of the resulting tissue and will depend on the particular softening agent selected and the desired softness effect. Nevertheless, suitable amounts of softening agent added to the Yankee dryer, expressed as a weight percent solids based on the dry weight of fiber in the tissue, can be 0.05 weight percent or greater, more specifically from 0.05 to about 0.4 weight percent, still more specifically from about 0.1 to about 0.3 weight percent, and still more specifically from about 0.1 to about 0.2 weight percent.

DETAILED DESCRIPTION OF THE DRAWING

Figure 1:
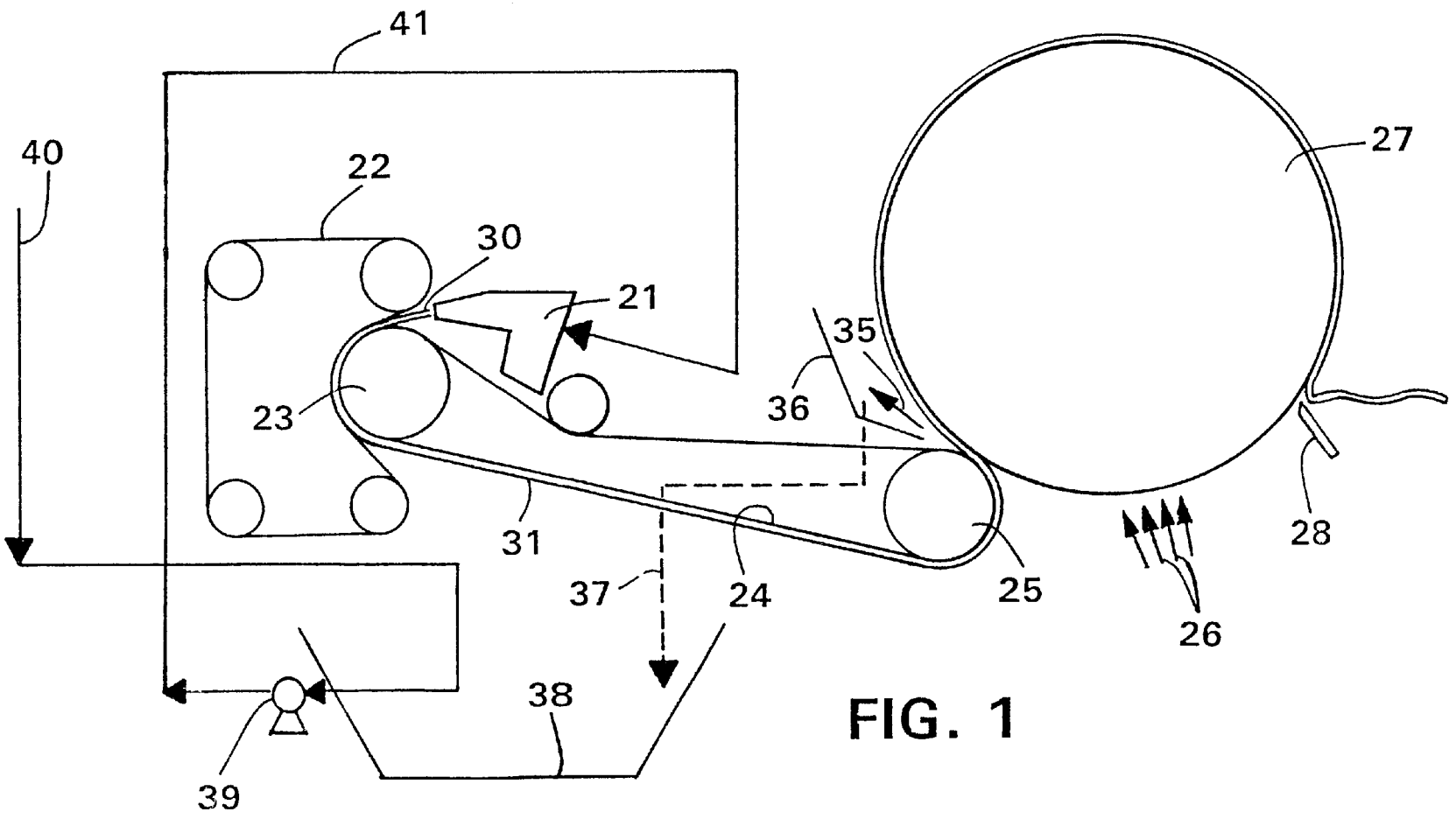
FIG. 1 is a schematic flow diagram of a wet-pressed tissue making process, illustrating the addition of softening agents to the surface of the Yankee dryer. Also shown is the white water recycle flow.

FIG. 1 is a schematic flow diagram of a conventional wet-pressed tissue making process useful in the practice of this invention, although other tissue making processes can also benefit from the stock prep method of this invention, such as throughdrying or other non-compressive tissue making processes. The specific formation mode illustrated in FIG. 1 is commonly referred to as a crescent former, although many other formers well known in the papermaking art can also be used. Shown is a headbox 21, a forming fabric 22, a forming roll 23, a paper making felt 24, a press roll 25, a spray boom 26, Yankee dryer 27, and a creping blade 28. Also shown, but not numbered, are various idler or tension rolls used for defining the fabric runs in the schematic diagram, which may differ in practice. As shown, the headbox 21 continuously deposits a stock jet 30 between the forming fabric 22 and felt 24, which is partially wrapped around the forming roll 23. Water is removed from the aqueous stock suspension through the forming fabric by centrifugal force as the newly-formed web traverses the arc of the forming roll. As the forming fabric and felt separate, the wet web 31 stays with the felt and is transported to the Yankee dryer 27.

At the Yankee dryer, the creping chemicals are continuously applied in the form of an aqueous solution to the surface of the Yankee dryer on top of the residual adhesive remaining after creping. In accordance with this invention, the creping chemicals can include one or more softening agents. The solution is applied by any conventional means, preferably using a spray boom 26 which evenly sprays the surface of the dryer with the creping adhesive solution. The point of application on the surface of the dryer is immediately following the creping doctor blade 28, permitting sufficient time for the spreading and drying of the film of fresh adhesive before contacting the web in the press roll nip.

The wet web 31 is applied to the surface of the dryer by means of the press roll 25 with an application force typically of about 200 pounds per square inch (psi). The incoming web is nominally at about 10% consistency (range from about 8 to about 20%) at the time it reaches the press roll. Following the pressing and dewatering step, the consistency of the web is at or above about 40%. Sufficient Yankee dryer steam power and hood drying capability are applied to this web to reach a final moisture content of about 2.5% or less.

Also illustrated in FIG. 1 is the white water recycle system. At the press roll nip, white water effluent 35 expressed from the wet web is collected in catch pan 36. The collected white water 37 drains into wire pit 38. Thick stock 40 having a consistency of about 3 percent is diluted with white water at the fan pump 39 to a consistency of about 0.1 percent. The diluted stock 41 is subsequently injected into the headbox 21 to form the wet web.

EXAMPLES

Example 1

Control

A soft tissue product was made in accordance with this invention using the overall process of FIG. 1. More specifically, a papermaking furnish was prepared consisting of 35% northern softwood kraft (NSWK), 15% High Maple Quinnesec and 50% Eucalyptus fibers. The Quinnesec and eucalyptus pulps were beaten together at about 6% consistency. The NSWK was beaten separately at about 6% consistency. The two pulp streams were blended together before dilution.

The blended furnish was then further diluted to about 0.1 weight percent based on dry fiber, fed to a headbox and deposited from the headbox onto a multi-layer polyester forming fabric to form the tissue web. The web was then transferred from the forming fabric to a conventional wet-pressed carrier felt. The water content of the sheet on the felt just prior to transfer to the Yankee dryer was about 88 percent. The sheet was transferred to the Yankee dryer with a vacuum pressure roll. Nip pressure was about 230 pounds per square inch. Sheet moisture after the pressure roll was about 42 percent. The adhesive mixture sprayed onto the Yankee surface just before the pressure roll consisted of 28 percent polyvinyl alcohol, 58 percent polyamide resin (KymeneLX) and 14 percent release agent (Quaker 2008) . The spray application rate was about 4.2 pounds of dry chemical per metric ton of fiber. A natural gas heated hood partially enclosing the Yankee had a supply air temperature of 626 degrees Fahrenheit to assist in drying. Sheet moisture after the creping blade was about 2.0 percent. Machine speed was about 4100 feet per minute. The crepe ratio was 1.30, or 30 percent. The resulting tissue was plied together and calendered with two steel rolls at about 70 pounds per lineal inch. The two-ply product had the dryer side plied to the outside. When converted, the finished basis weight of the two-ply facial tissue at TAPPI standard temperature and humidity was about 17 pounds per 2880 square feet.

Example 2

Invention

A soft tissue product was made in accordance with this invention using the overall process of FIG. 1. More specifically, a papermaking furnish was prepared consisting of 35% northern softwood kraft (NSWK), 15% High Maple Quinnesec and 50% Eucalyptus fibers. The Quinnesec and eucalyptus pulps were beaten together at about 6% consistency. The NSWK was beaten separately at about 6% consistency. The two pulp streams were blended together before dilution.

The blended furnish was then further diluted to about 0.1 weight percent based on dry fiber, fed to a headbox and deposited from the headbox onto a multi-layer polyester forming fabric to form the tissue web. The web was then transferred from the forming fabric to a conventional wet-pressed carrier felt. The water content of the sheet on the felt just prior to transfer to the Yankee dryer was about 88 percent. The sheet was transferred to the Yankee dryer with a vacuum pressure roll. Nip pressure was about 230 pounds per square inch. Sheet moisture after the pressure roll was about 42 percent. The adhesive mixture sprayed onto the Yankee surface just before the pressure roll consisted of 22 percent polyvinyl alcohol, 34 percent polyamide resin (KymeneLX) and 44 percent imidazoline softening agent (methyl-1-oleyl amidoethyl-2-olyel imidazolinium methylsulfate, identified as C-6001, commercially available from Witco Corporation). The spray application rate was about 7.8 pounds of dry chemical per metric ton of fiber. A natural gas heated hood partially enclosing the Yankee had a supply air temperature of 626 degrees Fahrenheit to assist in drying. Sheet moisture after the creping blade was about 2.0 percent. Machine speed was about 4100 feet per minute. The crepe ratio was 1.27, or 27 percent. The resulting tissue was plied together and calendered with two steel rolls at about 70 pounds per lineal inch. The two-ply product had the dryer side plied to the outside. When converted, the finished basis weight of the two-ply facial tissue at TAPPI standard temperature and humidity was about 17 pounds per 2880 square feet. Consumers were asked to compare this tissue and the Control tissue of Example 1 to a common competitive tissue. This tissue was preferred for softness by 43 percent of the consumers, whereas the Control tissue was preferred by 30 percent of the consumers. This represents a significant improvement in softness attributable to the method of this invention.

It will be appreciated that the foregoing examples, given for purposes of illustration, are not to be construed as limiting the scope of this invention, which is defined by the following claims and all equivalents thereto.

We claim:

1. A method for making creped tissue comprising (a) forming a wet tissue web by depositing an aqueous papermaking furnish onto a forming fabric; (b) partially dewatering the tissue web; (c) applying a creping adhesive and about 0.05 weight percent or greater, based on the weight of dry fiber in the tissue web, of one or more softening agents to the surface of a Yankee dryer, said softening agents being selected from the group consisting of an silicone quaternary and a phospholipid; (d) adhering the tissue web to the surface of the Yankee dryer such that the softening agent is transferred to the tissue web; and (e) creping the web.

2. The method of claim 1 wherein the amount of softening agent added to the surface of the Yankee dryer is from 0.05 to about 0.4 weight percent.

3. The method of claim 1 wherein the amount of softening agent added to the surface of the Yankee dryer is from about 0.1 to about 0.3 weight percent.

4. The method of claim 1 wherein the amount of softening agent added to the surface of the Yankee dryer is from about 0.1 to about 0.2 weight percent.

5. The method of claim 1 wherein the softening agent is a phospholipid.

6. The method of claim 1 wherein the softening agent is a silicone quaternary.

7. The method of claim 1 wherein the creping adhesive comprises polyvinyl alcohol and a polyamide resin.

* * * * *